US009856652B1

(12) United States Patent
Pissetti

(10) Patent No.: US 9,856,652 B1
(45) Date of Patent: Jan. 2, 2018

(54) DOME STRUCTURE

(71) Applicant: Cassio Pissetti, Parana (BR)

(72) Inventor: Cassio Pissetti, Parana (BR)

( * ) Notice: Subject to any disclaimer, the term of this patent is extended or adjusted under 35 U.S.C. 154(b) by 0 days.

(21) Appl. No.: 15/344,398

(22) Filed: Nov. 4, 2016

(51) Int. Cl.

| | |
|---|---|
| ***E04B 7/18*** | (2006.01) |
| ***E04D 13/03*** | (2006.01) |
| ***E06B 3/66*** | (2006.01) |
| ***E06B 3/673*** | (2006.01) |
| *E04B 7/08* | (2006.01) |
| *E04B 7/10* | (2006.01) |

(52) U.S. Cl.
CPC ..... *E04D 13/0305* (2013.01); *E04D 13/032* (2013.01); *E06B 3/66* (2013.01); *E06B 3/673* (2013.01); *E04B 7/08* (2013.01); *E04B 7/10* (2013.01); *E04B 7/102* (2013.01)

(58) Field of Classification Search
CPC ..... E04B 1/3211; E04B 1/32; E04B 1/3544; E04B 1/3223; E04B 7/10; E04B 7/102; E04B 7/08; E04D 13/0305; E04D 13/032; E06B 3/66; E06B 3/673
USPC ..... 52/200, 80.1, 81.1, 81.2, 81.3, 81.4, 52/DIG. 10
See application file for complete search history.

(56) References Cited

U.S. PATENT DOCUMENTS 2,151,234 A * 3/1939 Rutten ..... E04B 7/102 52/245
3,916,589 A * 11/1975 Richter ..... E04B 1/3211 52/464
4,400,927 A * 8/1983 Wolde-Tinase ..... E04B 1/3211 269/289 R
4,663,898 A * 5/1987 Yacaboni ..... E02D 27/42 52/167.1
4,720,947 A * 1/1988 Yacaboni ..... E02D 27/42 52/167.1
4,862,652 A * 9/1989 Lockwood ..... E04B 1/3211 29/432.1
5,146,719 A * 9/1992 Saito ..... E04B 1/3211 52/80.1
5,163,257 A * 11/1992 Crowell ..... E04B 7/14 52/200
5,379,557 A * 1/1995 Kotter ..... E01F 8/0023 52/591.2
2007/0068096 A1* 3/2007 O'Hagin ..... E04D 1/30 52/200
2011/0289870 A1* 12/2011 Nemazi ..... E04C 1/42 52/200

(Continued)

*Primary Examiner* — Chi Q Nguyen

(57) ABSTRACT

The invention is related to the field of civil engineering, particularly related to the translucent roofs of buildings, and regards the production of polycarbonate dome structure or translucent material, made of double lens and tube formation, which allows the installation and mounting of the same in-line, in the roofing structures, targeting design and extending day light in the inner area of buildings, even at low climatic condition, reducing the passage of excessive heat into the environment to be illuminated. In addition to reducing heat passage by approximately 30%, its use installation will take place linearly and non-point, so that natural light is distributed more homogeneously in the environment. The material for its manufacture can come from prismatic polycarbonate, acrylic or other compatible material and its manufacturing process adopts vacuum system forming (thermoforming).

4 Claims, 2 Drawing Sheets

(56) References Cited

U.S. PATENT DOCUMENTS

2012/0073490 A1* 3/2012 Kohnen ..... B63G 8/04
114/312
2016/0083963 A1* 3/2016 Griffin ..... E04D 13/0305
52/200

* cited by examiner

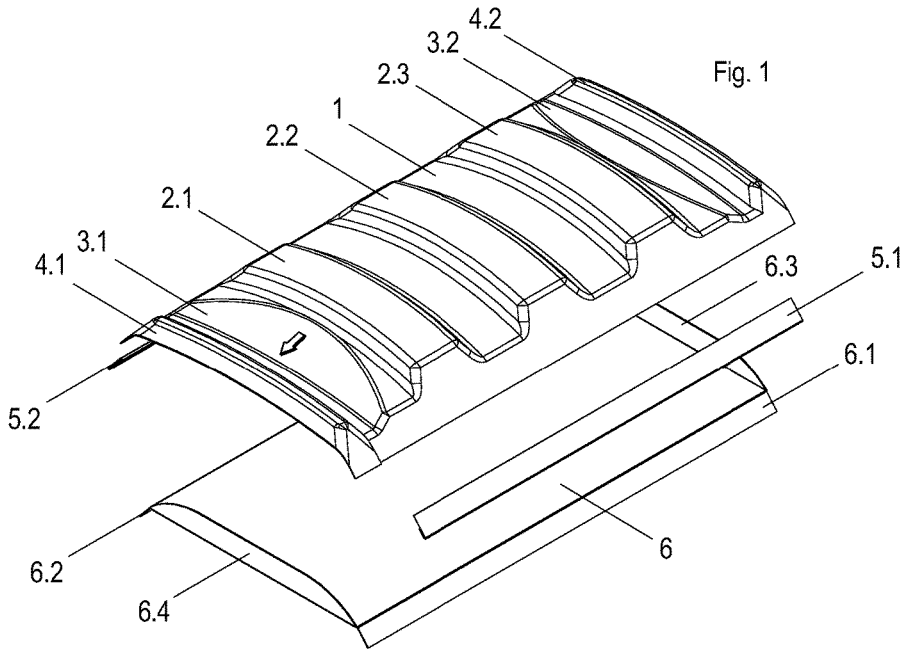
Fig. 1
Fig. 2
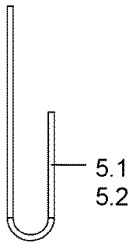
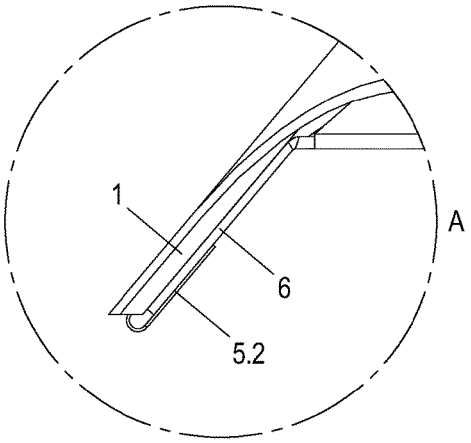
Fig. 3
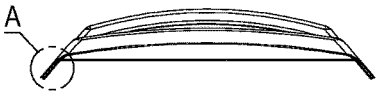

DOME STRUCTURE

TECHNICAL FIELD

The present invention relates to the field of civil engineering, particularly related to translucent covers for buildings, and concerns the production of a polycarbonate dome assembly, consisting of double lenses and tube formation, which allows the installation and assembly in line, in the roofing structures, targeting design and to extend day light in the inner area of buildings, even at low climatic condition, reducing the passage of excessive heat into the environment to be illuminated.

BACKGROUND OF THE INVENTION

In civil construction, roofing in general are commonly used to provide protection from the sun or rain for commercial and industrial environments. These constructs can be composed of different structures and materials, using commonly precast concrete or steel for the assembly of base and different materials for the cover from heavier materials such as metal alloys, concrete tiles, to lighter materials as plastic, thin metal alloys and polycarbonate.

The constructive disposition corresponds to the development of a sealing translucent prismatic curved plate of polycarbonate, preferably following the configuration of the transparent curvilinear polycarbonate dome obtaining a compact modular assembly provided with double transparent glass and heat retaining tube, of projection and expansion of natural light, thus increasing considerably the clarity of the inner area to be illuminated, with advantage be mounted in line with the other compact modular assemblies, structural ceiling works, yielding a greater use of natural lighting, reducing heat to be transferred into the environment, and a considerable decrease in the consumption of electricity needed to light the ambient, thereby contributing to savings.

STATE OF THE ART

It is known to those skilled in the metallic structures for buildings segment covers, in particular, the use of polycarbonate is well known in the art. In some situations the covers are attached to the sheet metal to give better protection and strength to the structure, while also ensuring the passage of light to the area under the frame. Specifically for these cases mounting systems are used which employ various accessories such as dowels, screws, adhesive, etc., so as to allow correct positioning of the material with each other (polycarbonate and metal), as well as to waterproof the structure, in addition to having a particular type of profile for fitting and fixing elements.

However in the current art there is no system which provides use and installation in a linear form and non-point, so that natural light is distributed more homogeneously in the environment without transmitting heat to the inner environment.

It is also known of the use of double lenses in the exterior, but only in individual and point module, non-linear, whose in-line mounting in building covers makes it quite expensive, because of the construction characteristics of the said module, making it application impractical.

Brazilian patent application PI1004383-7, shows improvements in structures and mounting covers for natural light comprise a pair of stringers, a metal structure composed of two profiled longitudinal rows of tiles, domes modulated polycarbonate, metal belts and trimmings to finish. Although an innovative technology in many ways as is mentioned in the document, this invention presents no solution for controlling the heat distribution of brightness and higher.

Proposed Solution

In the state of the art there is no system that eliminates the steps and intermediate attachments, except those presented by the inventor in the Brazilian patent PI1004383-7 whose features claimed were the basis for the development of the provision in the dome facing provided with natural light covers that can capture, projection and expansion of natural lighting inside the premises, and the possibility of in-line on the roof structure of a factory, warehouse or other building, correct, optimized and very economical way, giving the owner considerable savings.

Thus a system and innovative method through the use of modules equipped with dual glasses for mounting in structures of this nature in order to correct problems currently found is necessary, including the delay in the assembly and exchange of elements of the structure, the difficulty fitting parts, the use of excess accessories both for assembly and for fixing the parts and less aesthetic appearance, as well as and especially the expansion of natural lighting in inner areas to be illuminated.

DESCRIPTION OF THE DRAWINGS

For better understanding, the description which follows seeks to highlight the proposal at the level of principle, not limited to the designs of the components, with reference to the following below listed illustrations:

FIG. 1, perspective view illustrating the arrangement of the dome and its components;

FIG. 2 orthographic view showing the configuration of longitudinal profiles shaped like an "U";

FIG. 3, front view detailing the function of the dome and crystal plate by the longitudinal profiles.

DETAILED DESCRIPTION OF THE INVENTION

Figure 4:
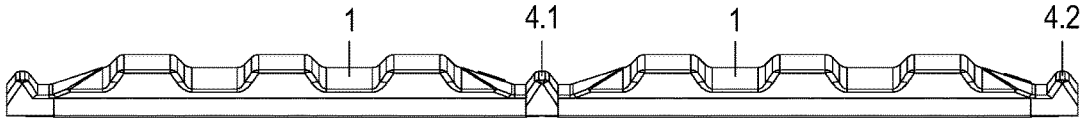
FIG. 4—Side view showing the linear junction of several domes by engagement of their ends named transverse horizontal flanges.

According to FIG. 1, the dome (1) in question is preferably curvilinear, substantially has a rectangular shape and is optionally provided with three cavities in parallelepiped protuberance (2.1, 2.2 and 2.3), trimmings (3.1 and 3.2) for finishing, horizontal transversal flanges (4.1 and 4.2) at both ends, longitudinal profiles (5.1, 5.2) preferentially "U" orthogonal and glass plate (6) positioned in the lower section of said dome, with said plate comprising longitudinal sealing flaps (6.1 and 6.2) and transverse sealing tabs (6.3 and 6.4).

According to FIGS. 2 and 3, the longitudinal profiles (5.1, 5.2) are made of metallic material and dimensioned in length to have a longitudinal extent of the dome. Such longitudinal profiles (5.1 and 5.2) are responsible for linking the dome (1) and the crystal plate (6) by pressure method, gluing, screwing, among other methods, to give a double lens (double glazing) in the bottom point of said dome (1), causing the day light apparatus not to transmits heat into the environment, this reducing heat passage by approximately 30%.

Several domes (1) (FIG. 4) can be fitted together by means of the arrangement of the transversal horizontal flanges (4.1 and 4.2) which position their bases one on top of the other, using installation in a linear form successively for any number of plates.

Several domes (3) are likely to fit with each other through the arrangement of the horizontal transversal flanges (4.1 and 4.2) which position their bases on each other, going on for "n" sheets in this proposition.

The fixing of domes in roofing is performed in the conventional manner using metal braces, girders, bolts, rivets, finials, among other known pieces of art and may have openings with width from 300 mm to 1,000 mm.

In addition to reducing heat passage by approximately 30%, its use/installation will take place linearly and non-point, so that natural light is distributed more homogeneously in the environment. The material for its manufacture can come from prismatic polycarbonate, acrylic or other compatible material and its manufacturing process adopts vacuum system forming (thermoforming). Other advantages of the structure consist in taking advantage of natural light, saving energy, be adaptable to any type of roof, avoiding leakage, as its tightness is 100%, does not damage the roofs tiles because of its attachment happens not on tiles, having high mechanical resistance and, finally, for having low thermal transmission.

Despite the aforementioned specific embodiment, there may be other embodiments of the solution comprised within the basic proposition here discussed, for example, with variations in the fittings, shapes and sizes, but using the same original concept represented should be understood that these configurations may be included in alternative embodiments of the invention. Furthermore, this invention is not limited to the representations illustrated and described here, it should be understood in its broadest scope. Modifications and other shapes are possible and are understood to be only defined within the scope of the following claims.

The invention claimed is:

1. A dome structure comprising:

a dome body (1), which is of a curved rectangular shape and has a plurality of protuberance protruding from the dome body with a cavity formed in each of the plurality of protuberance, wherein the plurality of protuberance are transversely formed on the dome body (1);

a glass plate (6) having two longitudinal sealing flaps (6.1, 6.2) longitudinally formed along two longitudinal sides of the glass plate (6) and extending downwardly with a pre-defined angle, which is the same as a curvature of the dome body (1); and at least two longitudinal profiles (5.1,5.2), each of the at least two longitudinal profiles (5.1, 5.2) including two parallel plates and a curved plate connecting the two parallel plates at ends, thus a cross section of each of the at least two longitudinal profiles (5.1, 5.2) is of a U shape, the two parallel plates and the curved plate thus forming a U-shaped space, wherein from the cross sectional view, one of the two parallel plates is wider than the other one of the two parallel plates;

wherein the two longitudinal sealing flaps (6.1, 6.2) of the glass plate (6) and two longitudinal sides of the dome body (1) are arranged in the U-shaped space formed by the two parallel plates and the curved plate of the at least two longitudinal profiles (5.1,5.2), respectively, and held by the two parallel plates of the at least two longitudinal profiles (5.1,5.2), respectively.

2. The dome structure according to claim 1, wherein the two longitudinal sealing flaps (6.1, 6.2) of the glass plate (6) and two longitudinal sides of the dome body (1) are attached together by means of pressure compressing, gluing, or screwing.

3. The dome structure according to claim 1, wherein the one of the two parallel plates which is wider than the other one of the two parallel plates of the at least two longitudinal profiles (5.1,5.2) is attached to the two longitudinal sides of the dome body (1), respectively, and the other one of the two parallel plates of the at least two longitudinal profiles (5.1,5.2) is attached to the two longitudinal sealing flaps (6.1, 6.2) of the glass plate (6), respectively.

4. The dome structure according to claim 1, further comprising two horizontal transversal flanges (4.1, 4.2) formed on two longitudinal ends of the dome body (1), wherein the two horizontal transversal flanges (4.1, 4.2) are engageable with horizontal transversal flanges (4.1, 4.2) of another dome body.

* * * * *